US008342762B2

(12) United States Patent
Saito

(10) Patent No.: US 8,342,762 B2
(45) Date of Patent: Jan. 1, 2013

(54) PRINT CONTROL APPARATUS AND CONTROL METHOD THEREOF AND PRINTER CONTROL PROGRAM AND PRINTER

(75) Inventor: Nobuhiro Saito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 855 days.

(21) Appl. No.: 11/480,935

(22) Filed: Jul. 6, 2006

(65) Prior Publication Data

US 2007/0019214 A1 Jan. 25, 2007

(30) Foreign Application Priority Data

Jul. 8, 2005 (JP) ..... 2005-200650

(51) Int. Cl.
*B41J 11/44* (2006.01)
*B41J 25/308* (2006.01)

(52) U.S. Cl. ..... 400/76; 347/8; 347/23

(58) Field of Classification Search ..... 347/19, 347/23, 149, 8; 400/76
See application file for complete search history.

(56) References Cited

U.S. PATENT DOCUMENTS

| | | | | |
|---|---|---|---|---|
| 6,084,606 | A | 7/2000 | Moriyama | 347/19 |
| 6,775,022 | B2 | 8/2004 | Noyes et al. | |
| 6,885,472 | B1 * | 4/2005 | Konno et al. | 358/1.15 |
| 2002/0018087 | A1 * | 2/2002 | Konno et al. | 347/14 |
| 2004/0183841 | A1 * | 9/2004 | Kunihiro | 347/9 |
| 2004/0184043 | A1 * | 9/2004 | Hirosugi et al. | 358/1.1 |

FOREIGN PATENT DOCUMENTS

| | | |
|---|---|---|
| JP | 8-207389 A | 8/1996 |
| JP | 10-264485 | 10/1998 |
| JP | 2000-343795 A | 12/2000 |

* cited by examiner

*Primary Examiner* — Matthew G Marini
(74) *Attorney, Agent, or Firm* — Fitzpatrick, Cella, Harper & Scinto

(57) ABSTRACT

Information indicating whether or not a printhead of a printer has been replaced or detached is obtained. Before the start of printing on the printer, a message is displayed prompting for print position adjustment of the printer if it is determined, based on the obtained information, that the printhead has been replaced or detached. The information indicating whether or not a printhead has been replaced or detached is initialized based on a response to the displayed message.

8 Claims, 18 Drawing Sheets

PRINT CONTROL APPARATUS AND CONTROL METHOD THEREOF AND PRINTER CONTROL PROGRAM AND PRINTER

FIELD OF THE INVENTION

The present invention relates to a print control apparatus and control method thereof and printer control program and printer which can adjust a print position of the printer by printing print position adjustment data on a printer.

BACKGROUND OF THE INVENTION

In an inkjet printer, a printhead (including a head cartridge which combines an ink tank and a head in a single unit) which ejects ink is configured to be detachable from a printer body. In the case of a head cartridge which combines an ink tank and head in a single unit, in particular, when an ink level becomes low, it is necessary to replace the cartridge including the head with a new one.

Generally, ink cartridges and inkjet heads are fastened to the cartridge by clamping levers, and thus always mounted in fixed positions. However, recent inkjet printers offer increasingly higher resolutions with extremely small nozzle spacing. Consequently, if a printhead is replaced, variations in outside shapes due to fabrication errors of cartridges or slight misalignment between cartridges and heads can cause dot positions of ink ejected from nozzles to deviate from dot positions produced by the printhead before the replacement. Such deviations in dot positions can result in quality loss of printed images. A print position adjustment function is provided to compensate for such deviations in dot positions.

There is a conventional technique according to which the printer automatically adjusts print position when a printhead is detached and attached. This technique has a problem in that the printer cannot be used for printing until the adjustment of the print position is completed. To deal with this problem, PC printer driver utilities are equipped with a function to adjust the print position on instructions from the user. However, general users do not know of the print position adjustment function or do not understand its meaning and they end up doing printing without adjusting the print position.

It is conceivable to bring up a pop-up dialog box at the start of printing or during printing, informing the user that the print position has not been adjusted yet. However, if such a warning message appears each time the user intends to do printing, it will seem obtrusive to the user, and may be even annoying especially if the user does not have any problem with printing results.

SUMMARY OF THE INVENTION

The present invention has an object to overcome the drawbacks of the conventional technique described above.

It is a feature of the present invention to provide a print control apparatus and control method thereof and printer control program and printer which can efficiently make print position adjustment for the printer.

According to the present invention, there is provided a printer control program comprising:

an obtaining step of obtaining information indicating whether or not a printhead of a printer has been replaced or mounted;

a display control step of displaying a message, before the start of printing on the printer, prompting for print position adjustment of the printer, in a case where it is determined based on the information obtained in the obtaining step that the printhead has been replaced or mounted; and an initialization step of initializing the information based on a response to the message displayed in the display control step.

According to the present invention, there is provided a print control apparatus comprising:

obtaining means for obtaining information indicating whether or not a printhead of a printer has been replaced or mounted;

display control means for displaying a message, before the start of printing on the printer, prompting for print position adjustment of the printer, in a case where it is determined based on the information obtained by the obtaining means that the printhead has been replaced or mounted; and initialization means for initializing the information based on a response to the message displayed by the display control means.

Incidentally, the summary of the invention is not intended to enumerate all the features of the present invention, and features described in other claims and combinations thereof can also constitute the invention.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will be described in detail below with reference to the drawings. However, the embodiments are not intended to limit the invention claimed herein and a combination of all the features described in the embodiments is not necessarily indispensable for the solution according to the invention.

Figure 1:
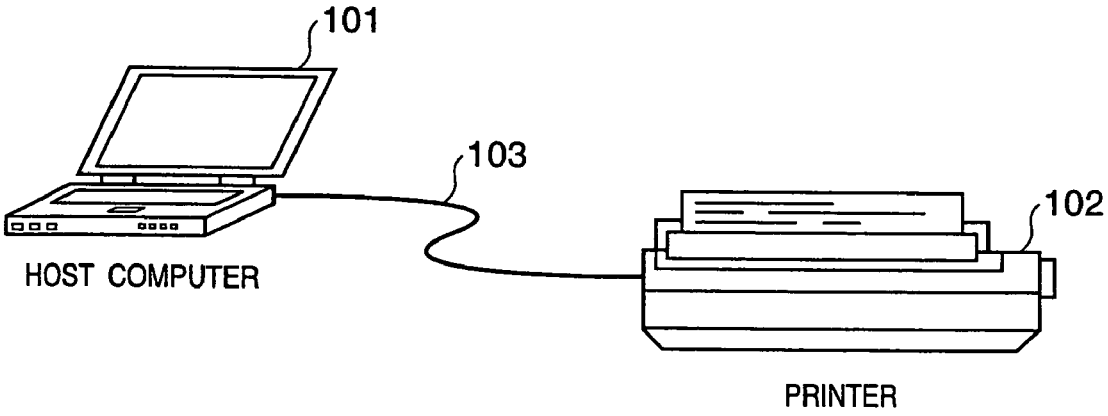
FIG. 1 is a diagram illustrating a print system according to an embodiment of the present invention.

FIG. 1 is a diagram illustrating a print system according to an embodiment of the present invention;

A host computer (PC) 101 is connected with a printer 102 via an interface 103. The host computer 101 conducts bi-directional communication with the printer 102 using a built-in printer driver. It creates print data, displays printer status, and transfers the created print data to the printer 102 in order to print the print data. Also, it can control operation of the printer 102 by transmitting various maintenance commands to the printer 102 via the printer driver. Incidentally, the interface 103 may be connected either via a cable or wirelessly, for example, via a wireless LAN.

Figure 2:
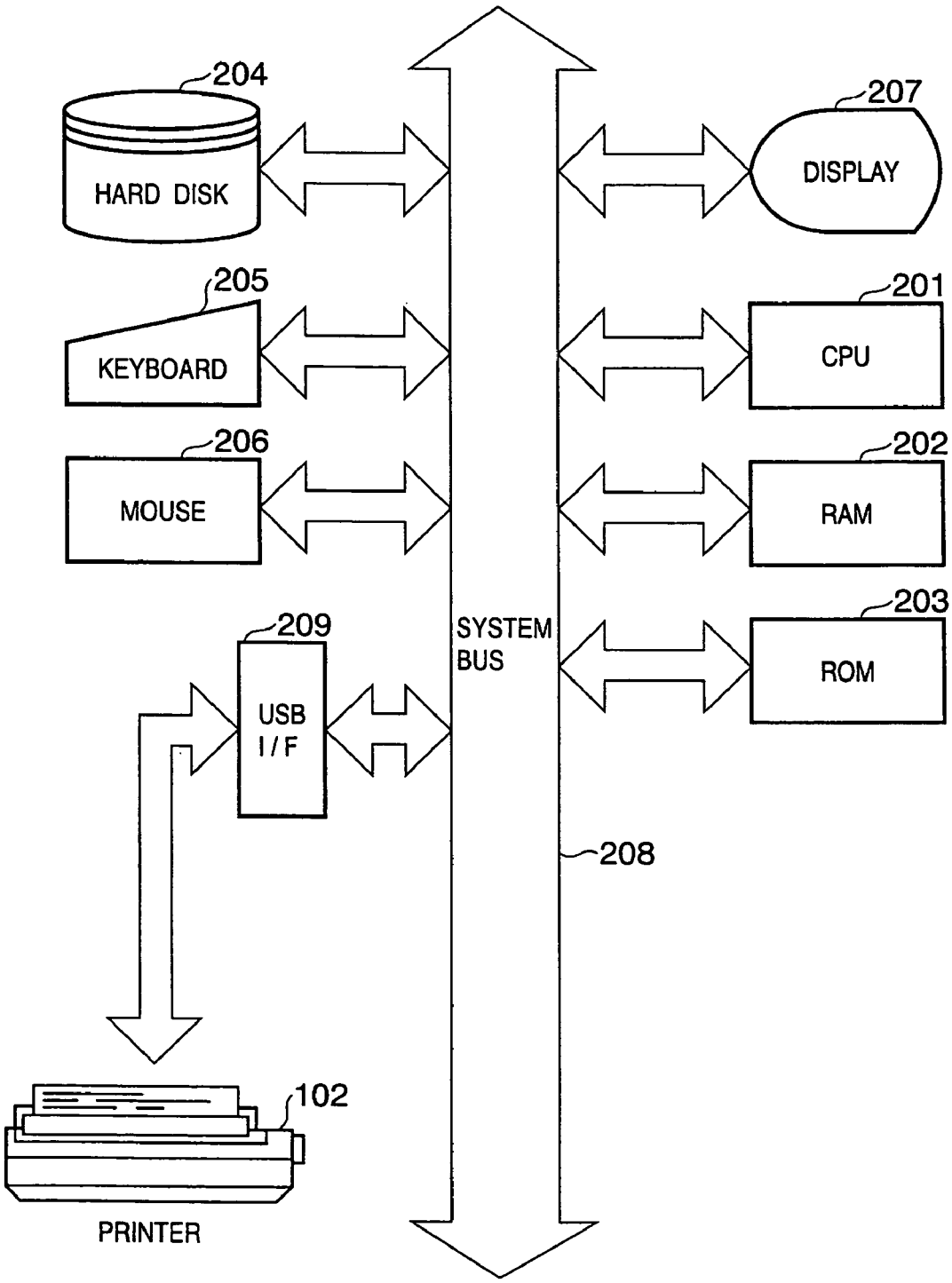
FIG. 2 is a block diagram illustrating a configuration of a host computer (PC) according to this embodiment.

FIG. 2 is a block diagram illustrating a configuration of the host computer (PC) 101 according to this embodiment. Incidentally, the PC 101 has a hardware configuration similar to those of commercially available personal computers.

A CPU 201 is a CPU such as a microcomputer and controls operation of the computer (hereinafter referred to as the "PC") 101. A RAM 202 stores programs and an OS executed by the CPU 201 and provides a work area for the CPU 201 to temporarily store various data during control operation. A ROM 203 stores a boot program, BIOS, and the like started on power-up of the PC 101 as well as various data used by the PC 101. Various applications for document processing, graphics processing, image processing, and the like as well as the OS and various programs including a printer driver which creates print data and displays printer status at the request of applications have been installed on a hard disk 204. The application programs are loaded onto the RAM 202 from the hard disk 204 and run under the control of the CPU 201 in response to commands entered by the user via a keyboard 205 or mouse 206. A display 207, which is a liquid-crystal, plasma, or SED display panel, is used to display a driver settings screen, printer status, and the like during execution of the printer driver. A system bus 208 connects the various components to the CPU 201 and transfers control signals, data, and the like among these components. Incidentally, it is assumed here that the printer 102 is connected via a USB interface 209.

Figure 3:
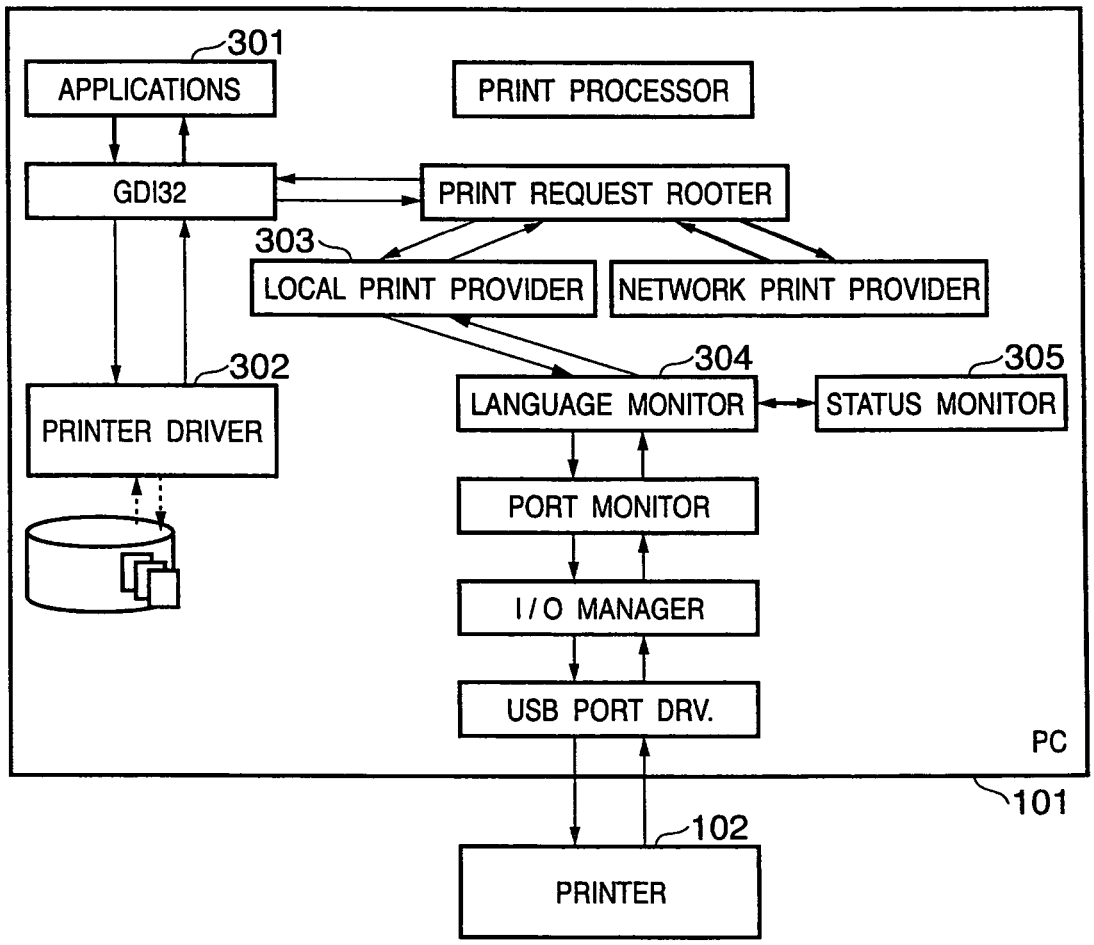
FIG. 3 is a diagram illustrating a flow of print data and flow of status display during printing when the PC according to this embodiment uses a Windows (registered trademark) OS.

FIG. 3 is a diagram illustrating a flow of print data and flow of status display during printing when the PC uses a Windows (registered trademark) OS.

Print data created by a printer driver 302 at the request of an application 301 are written into the printer 102 via Language Monitor 304 invoked by Local Print Provider 303. Status of the printer 102 is obtained through a read process carried out by the Language Monitor 304 and displayed by Status Monitor 305. If the status of the printer 102 is not appropriate for the print data, the Language Monitor 304 takes a measure at the start of printing such as making the Status Monitor 305 display a warning, instead of writing the print data into the printer 102. For example, upon receiving print data at the start of printing, the Language Monitor 304 obtains the status of the printer 102 instead of writing the print data immediately to the printer 102. If, for example, a unit required by the print data is not connected to the printer 102, the Language Monitor 304 makes the Status Monitor 305 display a warning instead of writing the print data to the printer 102. This allows the user to view the warning on the display 207 and take measures needed for printing. When it is ready to print the print data, the print data are written to the printer 102. These processes make it possible to prevent situations in which the printer 102 would not satisfy printing conditions, resulting in error or failing to print.

Figure 4:
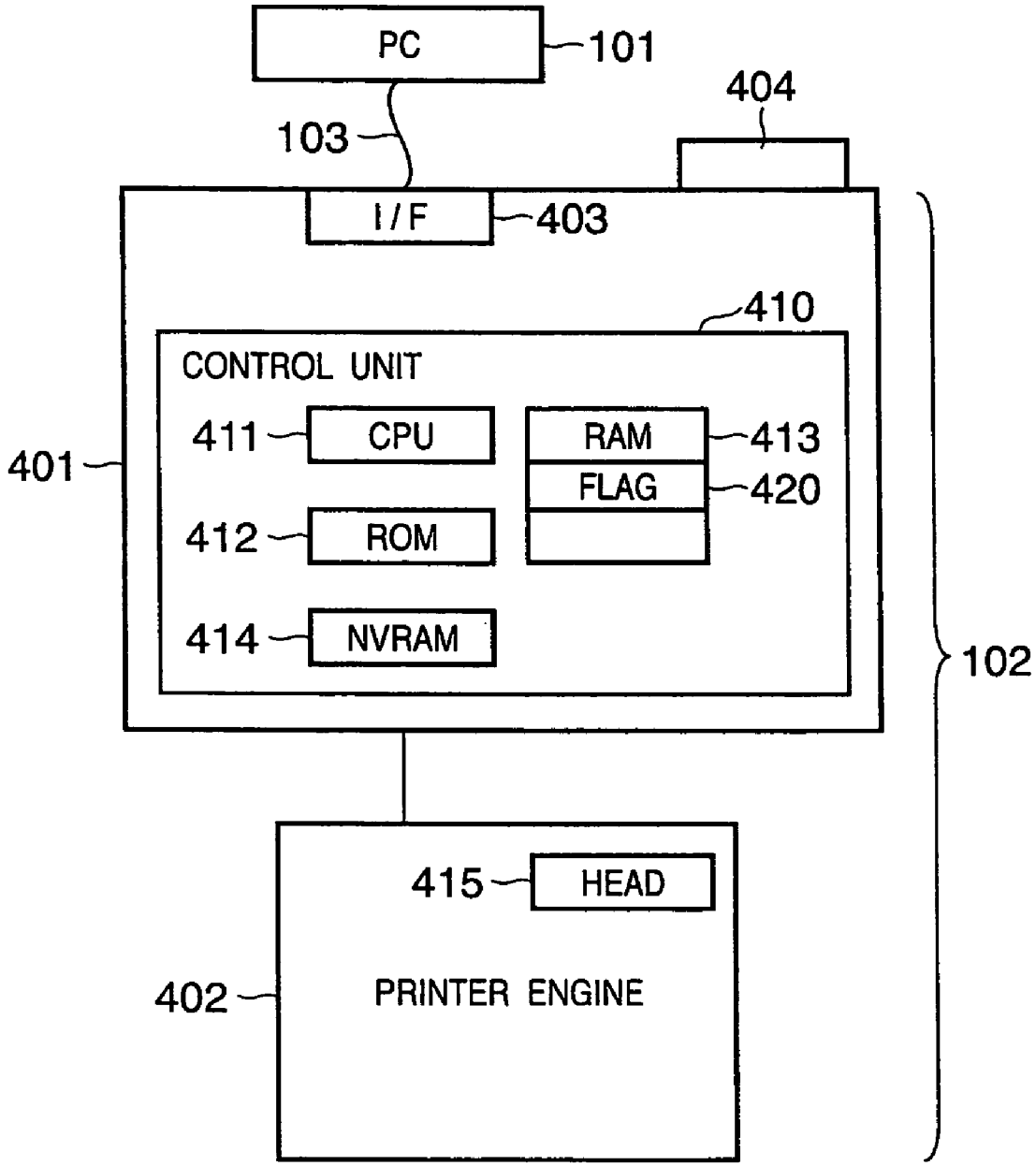
FIG. 4 is a block diagram showing a general configuration of a printer according to this embodiment.

FIG. 4 is a block diagram showing a general configuration of the printer 102 according to this embodiment, where the same components as those in the preceding figures are denoted by the same reference numerals as the corresponding components.

The printer 102 consists mainly of a main body 401 and printer engine 402. The main body 401 is equipped with a controller 410 which controls the operation of the printer 102. An interface unit 403 exchanges data with the PC 101 via a USB or other interface 103. The controller 410 has a CPU 411 such as a microprocessor, ROM 412 which stores programs executed by the CPU 411 and various data, and RAM 413 which temporarily saves various data and provides a work area during control operation by the CPU 411. Also, the RAM 413 contains a flag 420 (also referred to as the first information) used to request print position adjustment after a head is removed and attached. The request flag for print position adjustment 420 turns on when a printhead 415 or head cartridge (which combines an ink tank and head in a single unit) of the printer engine 402 is removed for replacement or the like. The flag 420 is provided for each printhead if the printer engine 402 can carry multiple printheads. A NVRAM 414 is a non-volatile RAM such as a Flash Memory (registered trademark) and the flag 420 (first information) may be stored in it. Reference numeral 404 denotes a console panel which contains liquid-crystal or other display for use to display error and other messages to the user as well as various switches and buttons. Incidentally, the printhead 415 according to the present invention may be a head separate from an ink tank, or a head cartridge which combines an ink tank and head in a single unit.

In the printer engine 402, the printhead 415 can be attached and detached to/from the main body of the printer 102. The type and ID of the attached printhead 415 can be identified through electrical connection between an electrode on the attached printhead 415 and a terminal on the head carriage of the printer engine 402. The type and ID information about the head 415 is sent to the controller 410 and stored in the NVRAM 414. Consequently, the CPU 411 of the controller 410 can always identify what type of printhead (head cartridge) is attached, which printhead—a color printhead or monochrome printhead—is attached if both color and monochrome printheads are supported, what type of printhead has been replaced, and so on.

Figure 5:
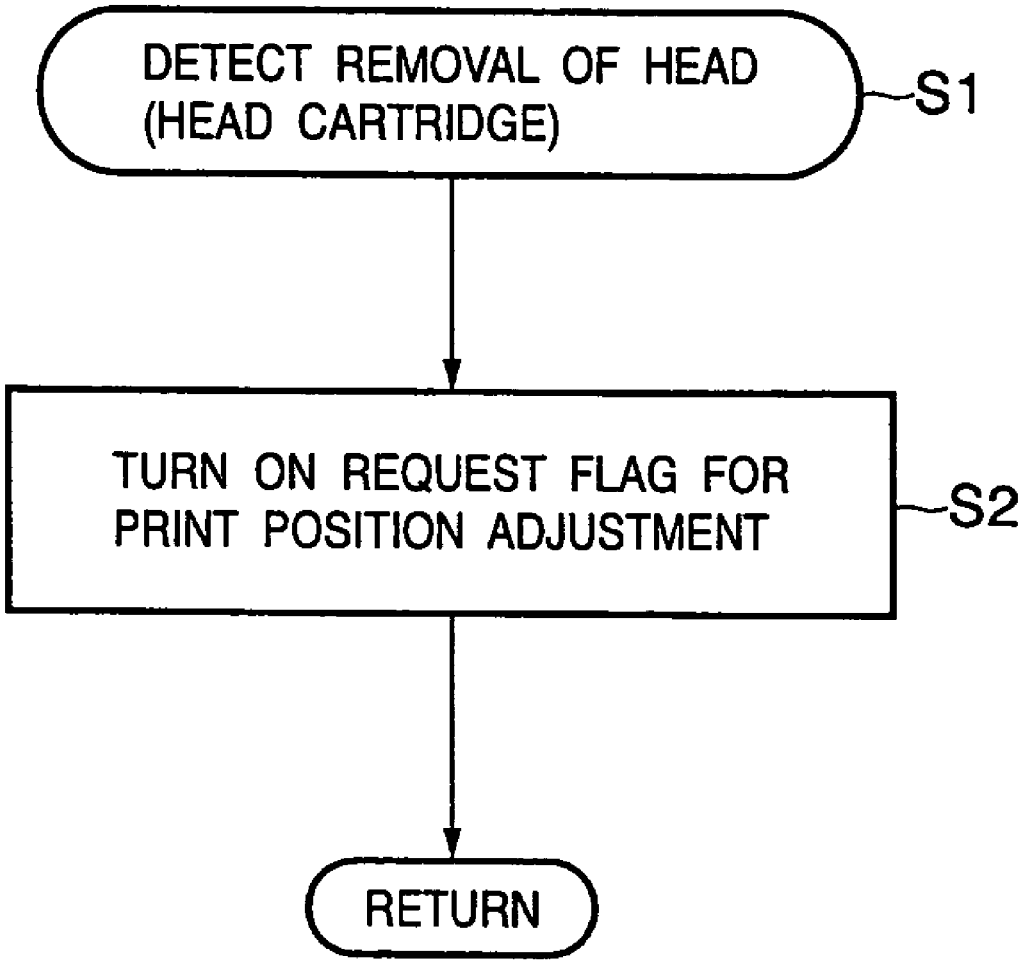
FIG. 5 is a flowchart showing processes performed on the printer according to this embodiment when a head (head cartridge) is removed.

FIG. 5 is a flowchart showing processes performed on the printer 102 according to this embodiment when a printhead (head cartridge) is removed. The program for these processes is stored in the ROM 412 and executed under the control of the CPU 411.

If removal of the head (head cartridge) is detected through electrical connection between the printhead 415 and carriage terminal as described above in Step S1, the request flag 420 for print position adjustment is turned on in Step S2. Alternatively, the process is activated by a routine which can detect detachment/attachment of the head anytime or an interrupt caused upon removal of the printhead to notify the CPU 411.

A color printer carries at least a color ink head and black ink printhead. If either of the printheads has been replaced or removed and then attached, relative position between nozzles in the replaced head and the other printhead may shift by a very small distance after the removal and the attachment due to variations in consistency between the printheads, in the shapes of the printheads, or the like. In such a case, dot positions of ink from nozzles of different heads may deviate from one another, making it impossible to reproduce colors correctly. To deal with this situation, if a printhead is replaced or if it is removed and attached, an UI screen of the printer driver prompts the user to print a pattern for a print position adjustment. Then based on the printing results in the print position adjustment, the user adjusts print position misalignment by entering print position adjustment data for each head. The request flag 420 for the print position adjustment prompts the user to adjust the print position. In other words, it indicates that a printhead has been removed and then attached. Status of the flag 420 is reported from the printer 102 to the PC 101 via the interface unit 403.

Figure 6:
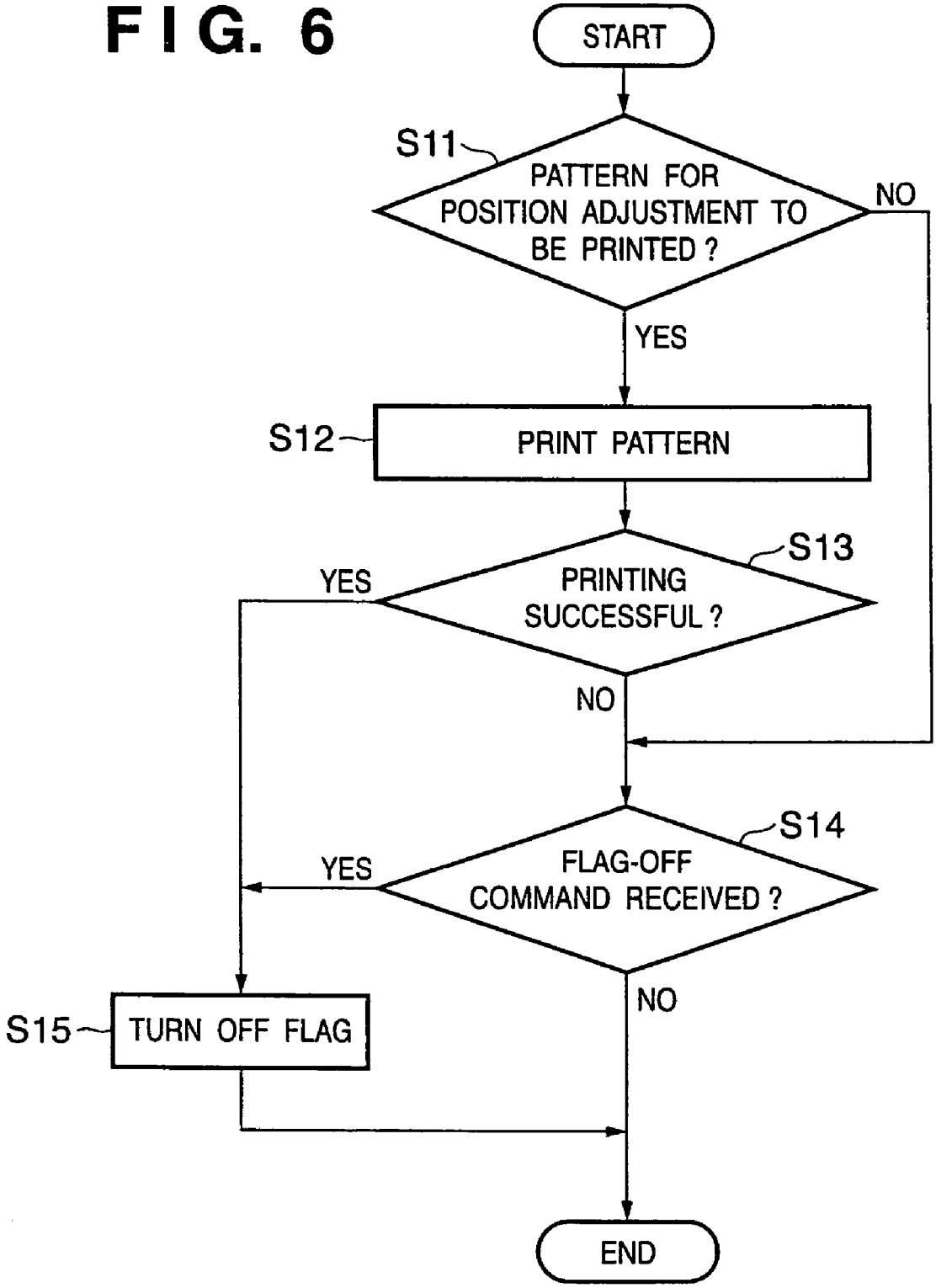
FIG. 6 is a flowchart showing processes performed on the printer according to the first embodiment when adjusting print position.

FIG. 6 is a flowchart showing processes performed on the printer 102 according to the first embodiment, upon adjusting print position. The programs for these processes are stored in the ROM 412 and executed under the control of the CPU 411.

In Step S11, it is determined whether a printhead misalignment check pattern for the print position adjustment is requested to be printed on the printer 102. Possible situations in this case include a situation in which a print position adjustment command or pattern data has been received from the printer driver 302 on the PC 101 and a situation in which the print position adjustment has been ordered via the console panel 404 of the printer 102 or the like. If the pattern for the print position adjustment is requested in Step S11, the process advances to Step S12 to print the pattern for the print position adjustment. Consequently, by referring to the printed results of the pattern, the user enters adjustment data for print position corresponding to each printhead on the UI screen of the printer driver 302 on the PC 101. The adjustment data thus entered are stored in a memory area (the RAM 202) managed by the printer driver 302 and are used for position adjustment of print data in subsequent printing processes.

If it is determined in Step S13 that the pattern for print position adjustment has been printed successfully, the process advances to Step S15 to turn off the request flag 420 for print position adjustment. If it is determined in Step S13 that the pattern for print position adjustment has not been printed successfully, the flow goes to Step S14 to determine whether a flag-off command (also referred to as the second information) has been received from the printer driver 302. If a flag-off command is received, the request flag 420 for print position adjustment is turned off in Step S15. Otherwise the processing is finished as it is. On the other hand, if it is determined in Step S11 that the pattern for print position adjustment is not requested, the flow goes to Step S14 to finish the processing.

In this way, when the pattern for print position adjustment is ordered to be printed and the printing is finished, the printer 102 according to the first embodiment automatically turns off the request flag 420 for the print position adjustment. The request flag 420 can also be turned off when a flag-off command is received from the PC 101.

Figure 7:
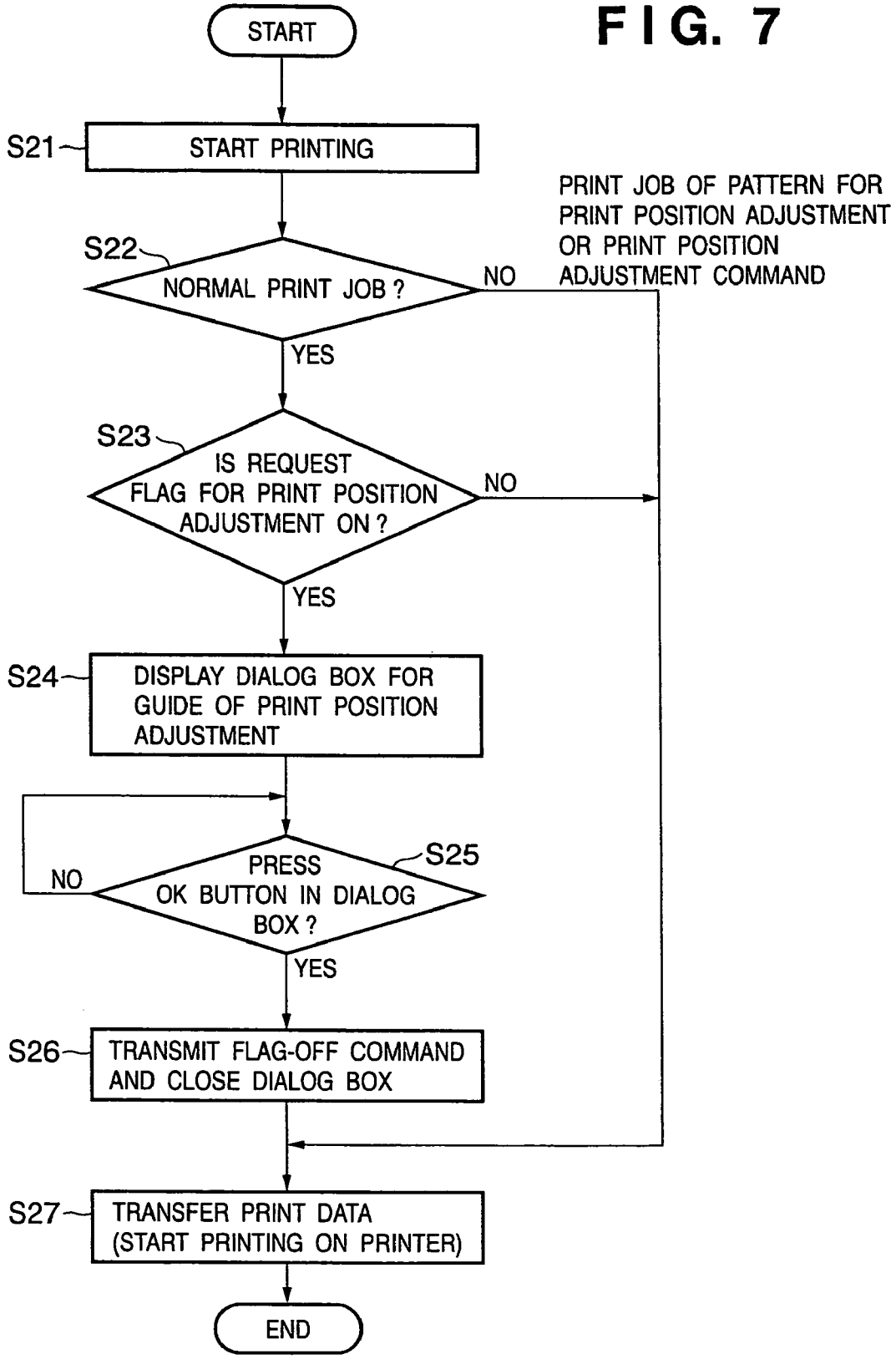
FIG. 7 is a flowchart illustrating processes performed by a printer driver of the PC according to the first embodiment.

FIG. 7 is a flowchart showing processes performed by the printer driver 302 of the PC 101 according to the first embodiment.

When the user of the PC 101 orders printing to be started in Step S21, a print job is spooled by a spooler and the Language Monitor 304 checks the print job in Step S22. Specifically, the Language Monitor 304 determines whether the print job is a normal print job or it concerns the pattern for print position adjustment or a print position adjustment command. It may be determined in step S22 using a job name of a spooled command job in the case of a print position adjustment command.

A print job of the pattern for print position adjustment may be indistinguishable from a normal print job both on the PC 101 and printer 102 because it has the same structure as the normal print job.

Figure 8:
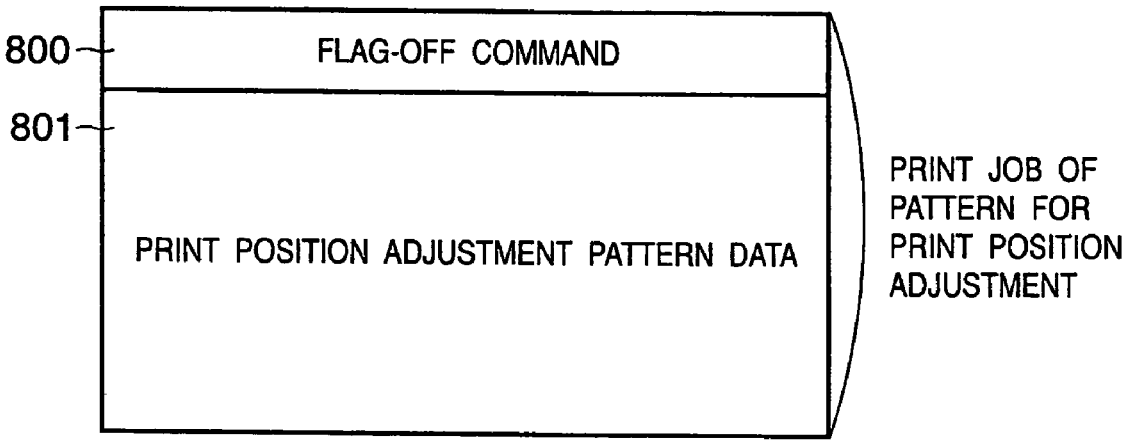
FIG. 8 is a diagram illustrating a data structure of a print job of a pattern for print position adjustment according to this embodiment.

Thus, a flag-off command 800 (second information) for turning off the request flag 420 (first information) for print position adjustment is added to the head of the print job of the pattern for print position adjustment when the print job is transmitted, as shown in FIG. 8.

FIG. 8 is a diagram illustrating the data structure of a print job of the pattern for print position adjustment according to this embodiment.

Reference numeral 801 denotes pattern data printed for print position adjustment. The flag-off command 800 for turning off the request flag 420 for print position adjustment is contained in the head of the pattern data.

By analyzing data of a spooled print job, the Language Monitor 304 determines whether the spooled print job is a normal print job or a print job of the pattern for print position adjustment. The use of a structure such as shown in FIG. 8 for the job of the pattern for print position adjustment ensures that the request flag 420 for print position adjustment be turned off from the printer 102 after job transfer.

If it is determined in Step S22 that the job is a print job of the pattern for print position adjustment or a job of a print position adjustment command rather than a normal print job, the process advances to Step S27, where the Language Monitor 304 just transmits the spooled data as they are to the printer 102. Consequently, the pattern for print position adjustment is printed based on the print job or through execution of the print position adjustment command on the printer 102.

On the other hand, if it is determined in Step S22 that the job is a normal print job, the process advances to Step S23 to obtain the latest status of the printer 102 from the printer 102. Next, the Language Monitor 304 determines whether the request flag 420 for print position adjustment is on. If it is off, the process advances to Step S27, where the Language Monitor 304 transfers the print data to the printer 102 in order for the print data to be printed.

On the other hand, if it is determined in Step S23 that the request flag 420 for print position adjustment is on, the process advances to Step S24, where the Language Monitor 304 suspends the transfer of the print job to the printer 102 and instructs the Status Monitor 305 to display a dialog box for guide of print position adjustment.

Figure 9:
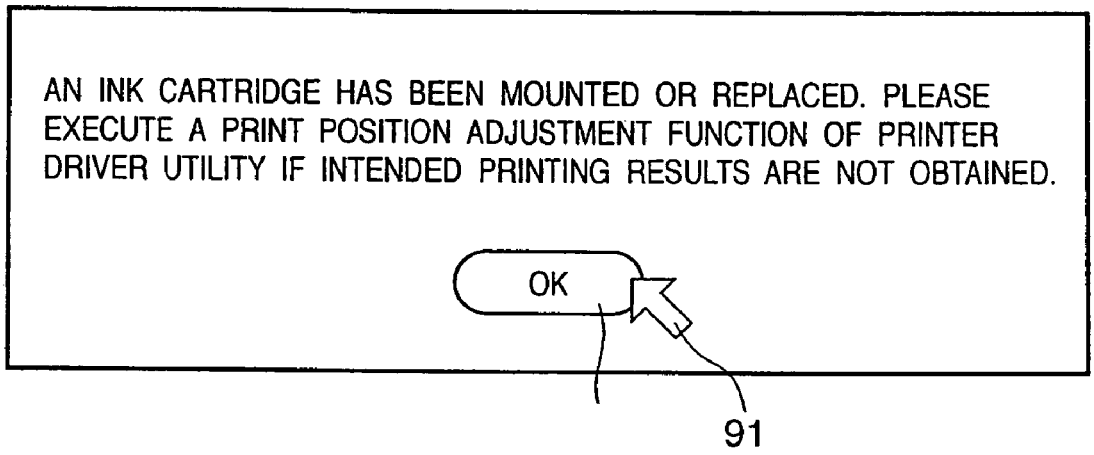
FIG. 9 is a diagram showing a display example of a dialog box for guide of print position adjustment brought up on the PC according to this embodiment.

FIG. 9 depicts a diagram showing a display example of the dialog box for guide of print position adjustment brought up on the PC according to this embodiment.

The dialog box in FIG. 9 informs the user that a printhead or head cartridge has been mounted or replaced. Also, it prompts the user to run a "print position adjustment function" of a printer driver utility if intended printing results can not be obtained because there may be head misalignment.

The guide dialog box is brought up-on the display 207 of the PC 101. Consequently, the user recognizes that print position adjustment is needed because a head (including a cartridge) has been removed and attached.

In Step S25, the Language Monitor 304 checks whether an OK button 90 in the dialog box shown in FIG. 9 is pressed with the mouse (the mouse 206 is clicked with a mouse cursor 91 positioned on the OK button 90). If the OK button 90 is pressed, the process advances to Step S26, where the Language Monitor 304 transmits a flag-off command for turning off the request flag 420 for print position adjustment to the printer 102 and closes the dialog box. The command is received by the printer 102 in Step S14 in FIG. 6 and the request flag 420 for the printer 102 is turned off. Since the status of the request flag 420 for print position adjustment obtained-subsequently at the start of printing is OFF, the dialog box for guide of print position adjustment no longer appears subsequently at the start of printing. This makes it possible to provide the minimum necessary guidance, making it no longer necessary for the user to repeatedly see the dialog box stating the need for print position adjustment.

In this way, the Language Monitor 304 transmits the command in Step S26 and after the Status Monitor 305 closes the dialog box for guide of print position adjustment, the Language Monitor 304 transfers the print data to the printer 102 in Step S27. This starts normal printing.

As described above, according to the first embodiment, the user is reminded of print position adjustment at the start of printing only once just after a replacement or attachment of a print head. This makes it possible to implement an efficient UI which does not give the user an impression of being warned.

Second Embodiment

In Step S22 in FIG. 7 according to the first embodiment, when a print job of the pattern for print position adjustment (FIG. 8) is transferred, the flag-off command 800 for turning off the request flag 420 for print position adjustment is included in the print job. In that case, when the head of the job is analyzed and processed, the request flag 420 is turned off in response to the flag-off command 800 by the printer which has received the print job of the pattern for print position adjustment. Subsequently, when printing the print position adjustment pattern data 801, error such as paper jam may occur, causing the processing to be terminated before the printing of the pattern for print position adjustment is completed. In that case, the request flag 420 for print position adjustment is turned off even though the printing of the pattern for print position adjustment fails.

To deal with such a situation, according to a second embodiment, a decision as to whether to keep the request flag 420 for print position adjustment turned off is made after it is determined whether the printing of the pattern for print position adjustment is completed.

Figure 10:
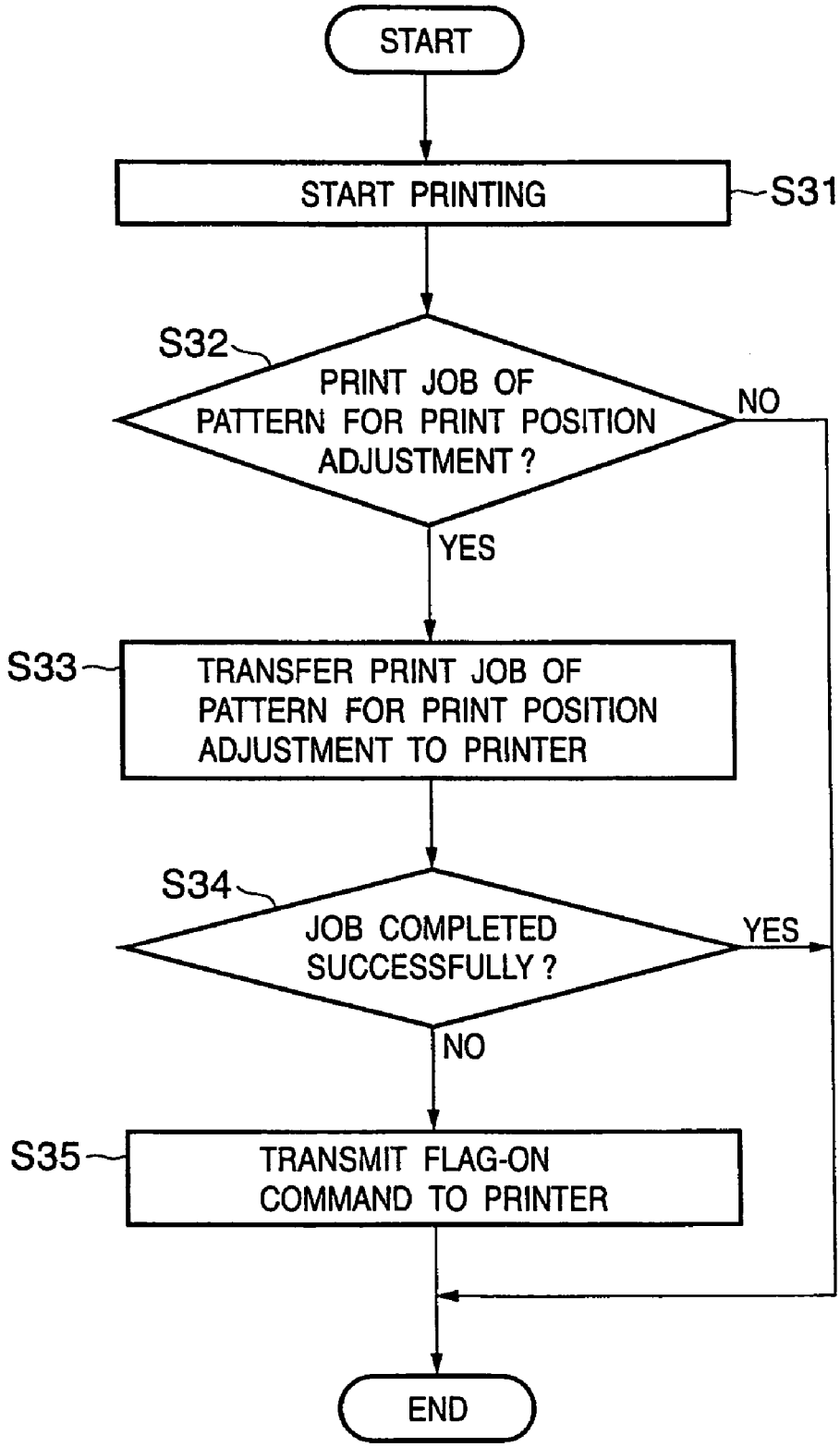
FIG. 10 is a flowchart illustrating processes performed by a printer driver on a PC according to a second embodiment of the present invention.

FIG. 10 is a flowchart illustrating processes performed by a printer driver on the PC 101 according to the second embodiment of the present invention.

When printing is started in Step S31, the Language Monitor 304 determines in Step S32 whether the print job is a print job of the pattern for print position adjustment. If it is, the process advances to Step S33, the Language Monitor 304 transmits the print job of the pattern for print position adjustment to the printer 102. Next, in Step S34, the Language Monitor 304 determines whether the job has been completed successfully on the printer. Possible methods for checking for completion of the job include a method which involves receiving a paper-ejection-complete page that indicates completion of printing and a method which involves determining whether the job has not been cancelled due an error occurring before the job is completed. If it is determined in Step S34 that the print job of the print position adjustment pattern has been completed successfully, the Language Monitor 304 finishes the processing. If it is determined in Step S34 that the print job has not been completed successfully, the process advances to Step S35, where the Language Monitor 304 of the printer driver 302 transfers a command (also referred to as the third information) for turning on the request flag 420 (first information) for print position adjustment to the printer 102 again. That is, the first information is restored.

Consequently, if the pattern for print position adjustment is not printed successfully on the printer 102, the request flag 420 for print position adjustment is turned on again. This makes it possible to warn the user by displaying the dialog box for guide of print position adjustment on the display 207 before starting printing on the printer 102 the next time.

Third Embodiment

Next, a third embodiment of the present invention will be described. The third embodiment not only displays the dialog box for guide of print position adjustment at the start of printing after a head (cartridge) is replaced or removed and then attached, recommending the user to run the print position adjustment function, but also makes the user actually adjust the print position at the same time.

Figure 11:
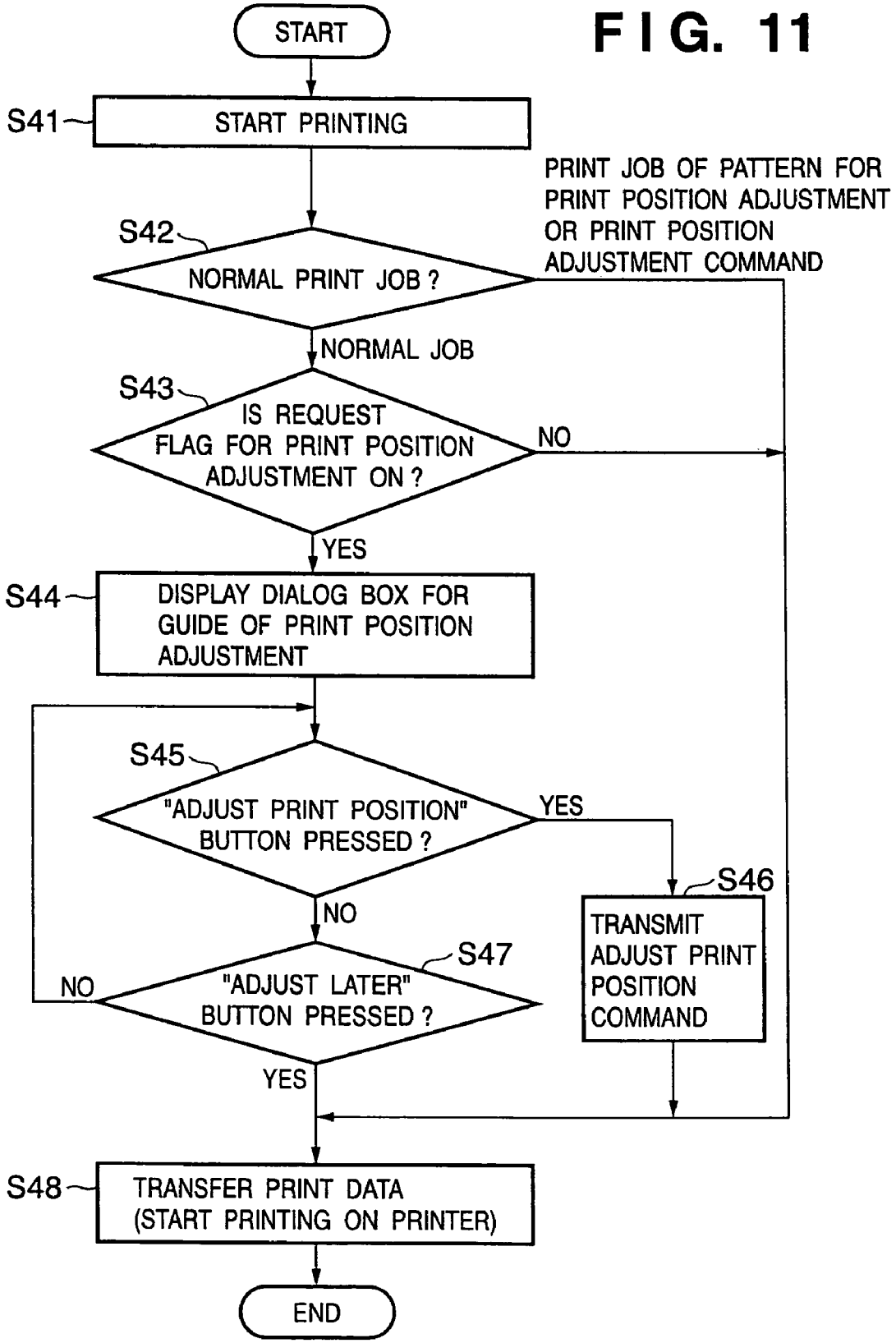
FIG. 11 is a flowchart illustrating processes performed on a PC according to a third embodiment of the present invention.

FIG. 11 is a flowchart illustrating processes performed on the PC 101 according to the third embodiment of the present invention.

In Step S41, printing is ordered by a user. In Step S42, the Language Monitor 304 determines whether a print job spooled by a spooler is a normal print job. The determination here is made in the same way as in the first embodiment (in S22 in FIG. 7). If the job is related to printing of the pattern for print position adjustment or issuance of a print position adjustment command, the process advances to Step S48, where the Language Monitor 304 transfers the spooled job as it is to the printer 102.

On the other hand, if it is determined in Step S42 that the job is a normal print job, the process advances to Step S43, where the Language Monitor 304 obtains the latest status of the printer 102. Next, it is determined whether the request flag 420 for print position adjustment is on. If the request flag 420 is off, the process advances to Step S48, where the Language Monitor 304 transfers the print data as it is to the printer 102 in order for printing to be started.

On the other hand, if it is determined in Step S43 that the request flag 420 is on, the process advances to Step S44 and the Language Monitor 304 causes the Status Monitor 305 to display the dialog box for guide of print position adjustment on the display 207.

Figure 12:
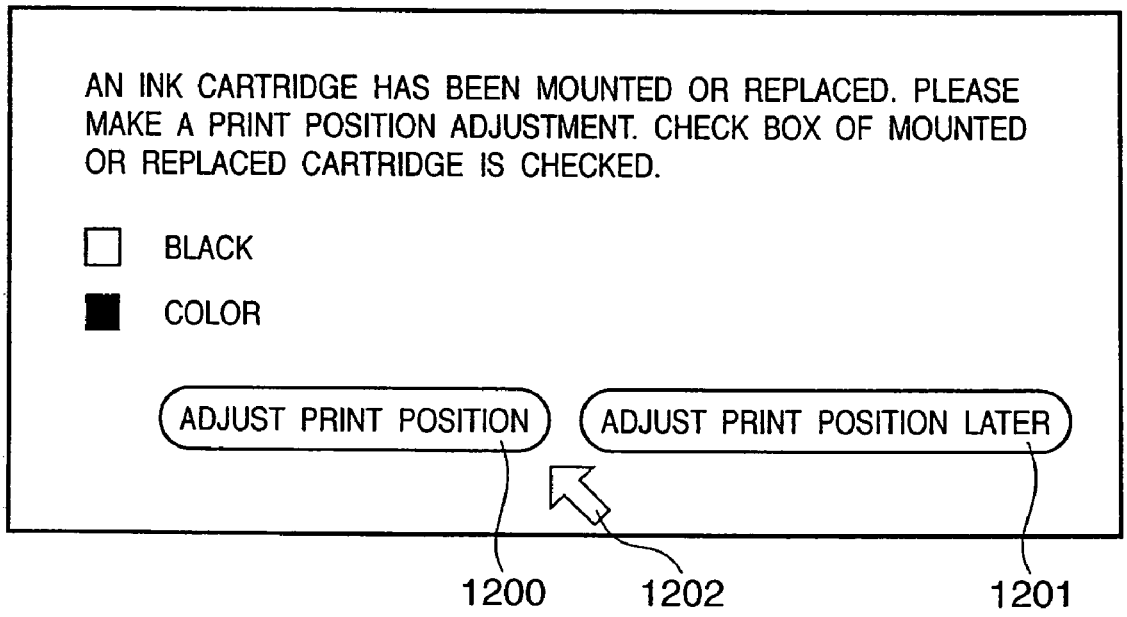
FIG. 12 is a diagram showing an example of a dialog box brought up in Step S44 in FIG. 11.

FIG. 12 is a diagram showing an example of the dialog box brought up in Step S44.

When multiple heads (cartridges) are mounted on the printer 102, the dialog box allows a head to be selected for print position adjustment. By obtaining status of the request flag 420 for print position adjustment from the printer 102, the Language Monitor 304 displays the dialog box on which a check box of the head (cartridge) which needs print position adjustment is marked. In the example of FIG. 12, it is shown that the color head has been replaced. This allows the user to see at a glance which head needs the print position adjustment and print the pattern for print position adjustment without determining by himself/herself which head needs the print position adjustment, the black head or color head (cartridge).

Also, the dialog box allows the user to select whether to adjust print position just now or later.

Next, in Step S45, the Language Monitor 304 checks whether an Adjust Print Position button 1200 is pressed (the mouse 206 is clicked with a mouse cursor 1202 positioned on the button 1200). If the button 1200 is pressed, the process advances to Step S46, where the Language Monitor 304 transmits an Adjust Print Position command to the printer 102. The transmitted command instructs the print position adjustment of only the head (color) checked in the dialog box.

Since the dialog box appears with the head (cartridge) which needs the print position adjustment checked as shown in FIG. 12, the user needs only to press the Adjust Print Position button 1200, and only the printhead which needs the print position adjustment has its position adjusted immediately. After the print position adjust command is transmitted to the printer 102, the pattern for print position adjustment is printed on the printer 102. Subsequently, the process advances to Step S48, where the Language Monitor 304 transmits the print data (spooled) which the user actually wants to print to the printer 102.

If it is determined in Step S45 that the Adjust Print Position button 1200 is not pressed, the process advances to Step S47, it is determined in Step S47 whether an Adjust Print Position Later button 1201 is pressed. If the button 1201 is pressed in the Step S47, this means that the user chooses not to adjust the print position for now while realizing the need for print position adjustment. Thus, instead of making the print position adjustment, the process advances to Step S48, where the Language Monitor 304 transfers the print data to the printer 102 in order for the print data to be printed, as in the case of normal printing.

Thus, according to the third embodiment, if a head is replaced or removed and then attached, the user is reminded of the need for print position adjustment by clearly indicating which head needs the print position adjustment.

Also, since the user can specify when to make the print position adjustment, if the user wants to do printing in a hurry, the user can go ahead with desired printing for the moment by putting off the print position adjustment.

The UI shown in FIG. 12 is brought up as a pop-up dialog box at the start of printing. Alternatively, it may be a UI used by the print position adjustment function included in the utility of the printer driver 302.

Fourth Embodiment

In the embodiments described above, various statuses of the printer 102 connected to the PC 101 and maintenance functions including print position adjustment are manipulated by the printer driver on the PC 101.

According to the fourth embodiment, print operations and various functions are implemented solely on a printer equipped with a display device such as a liquid-crystal monitor or on a multifunction printer without using a PC.

Processes performed on a multifunctional peripheral according to the fourth embodiment of the present invention will be described below.

Figure 13:
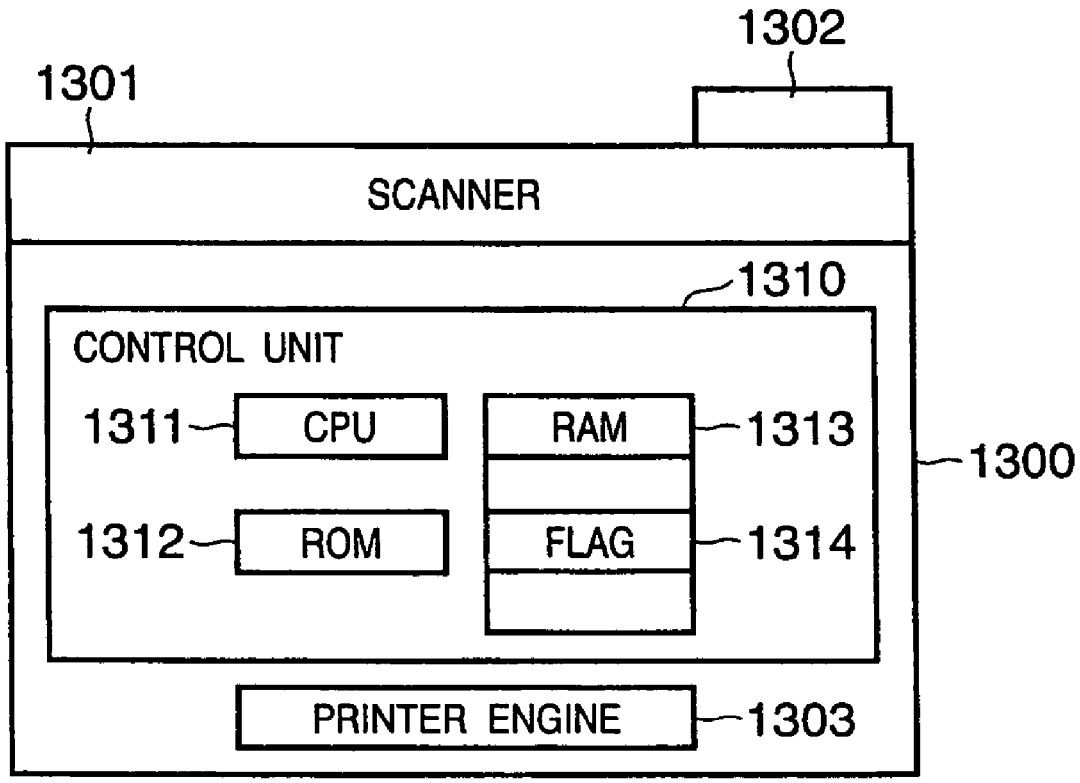
FIG. 13 is a diagram illustrating a general configuration of a multifunctional peripheral according to a fourth embodiment of the present invention.

FIG. 13 is a diagram illustrating a general configuration of the multifunctional peripheral according to the fourth embodiment of the present invention.

Figure 15:
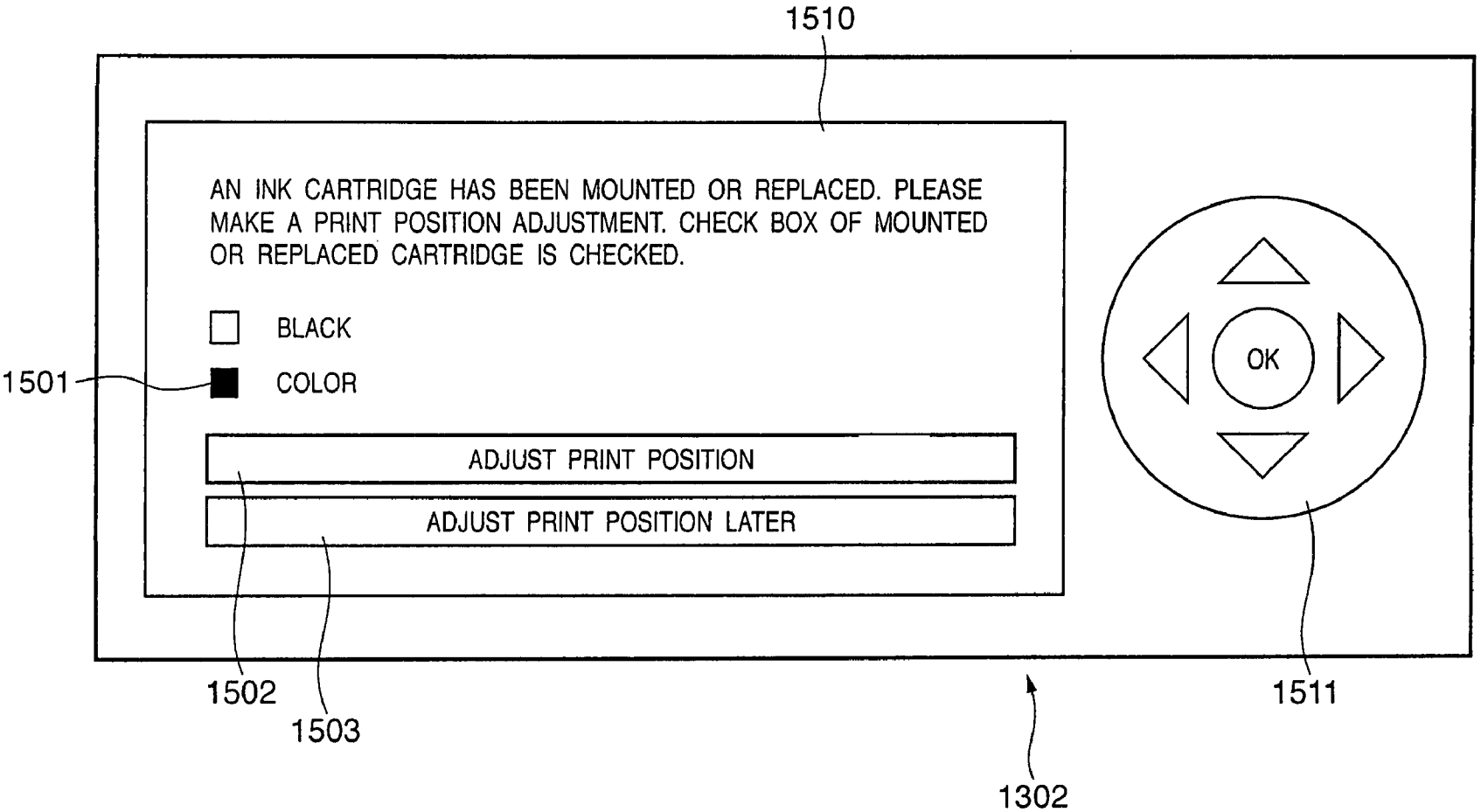
FIG. 15 depicts an external view showing an example of a console panel according to the fourth embodiment of the present invention.

Being equipped with a printer unit 1300 and scanner 1301, the multifunctional peripheral functions as a scanner which reads an original document and outputs image data, copy machine, PC printer which receives data from a PC and prints the received data, and a facsimile machine. A console panel 1302 is equipped with a display 1510 and button 1511, for example, as shown in FIG. 15.

The printer unit 1300 has a printer engine 1303 and control unit 1310 which controls printing processes performed by the printer engine 1303, operation of the scanner 1301, data reception and image processing performed by the PC printer, and operation of the copy machine and facsimile machine. The control unit 1310 has a CPU 1311 such as a microprocessor, ROM 1312 which stores programs executed by the CPU 1311, and RAM 1313 which provides a work area during control operation by the CPU 1311 and temporarily saves various data. The RAM 1313 contains a request flag 1314 for print position adjustment (which corresponds to the flag 420).

Figure 14:
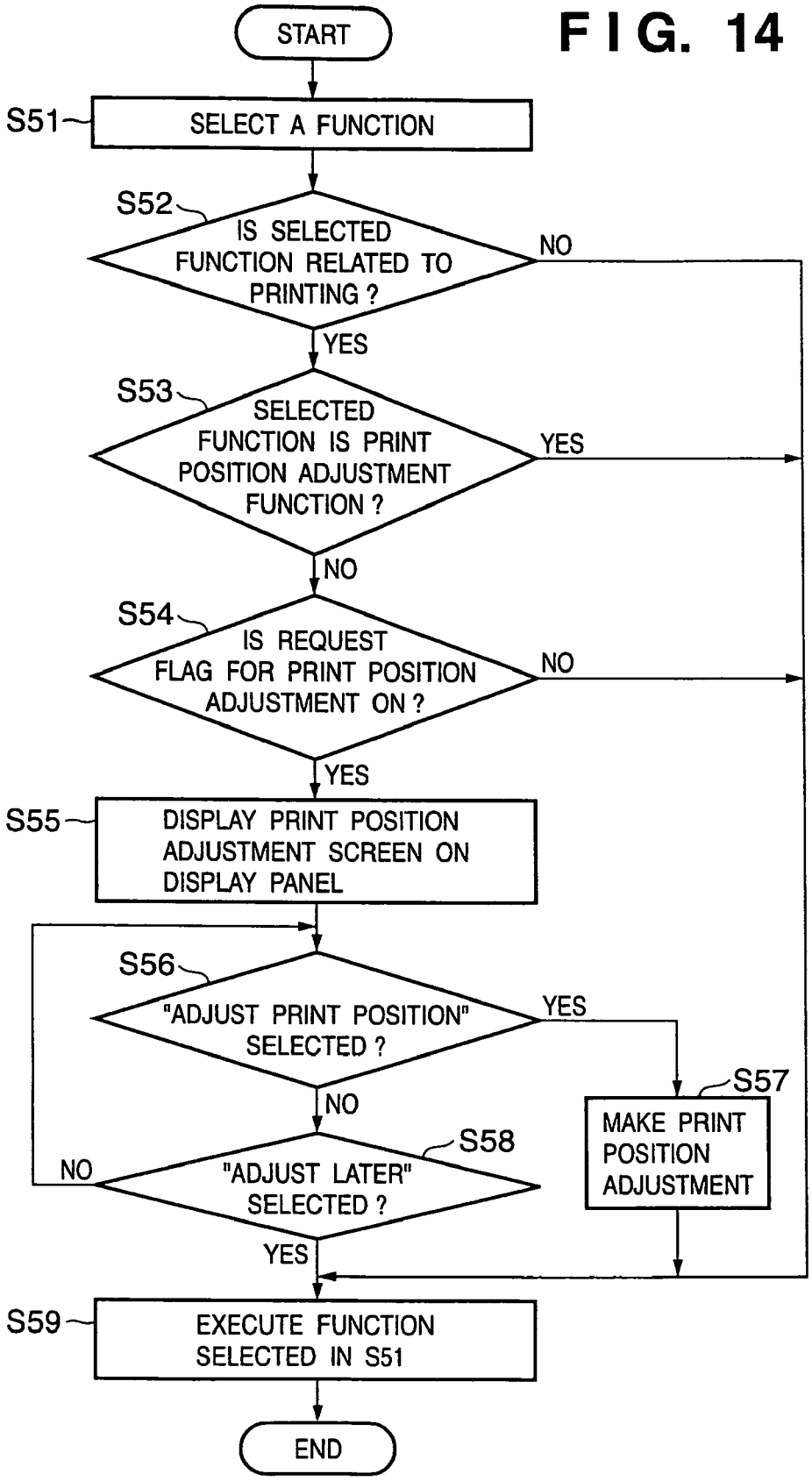
FIG. 14 is a flowchart illustrating processes performed on the multifunctional peripheral according to the fourth embodiment of the present invention.

FIG. 14 is a flowchart illustrating processes performed on the multifunctional peripheral according to the fourth embodiment of the present invention. The programs for these processes are stored in the ROM 1312 and executed under the control of the CPU 1311.

When a function to be executed is selected in Step S51, it is determined in Step S52 whether the selected function is related to printing. For example, in the case of a process which involves reading an original document with the scanner 1301 and writing the resulting image data in a file, it does not use the print function of the printer unit 1300. Thus, the flow goes to Step S59 to execute the function selected in Step S51. This makes it possible to execute any function other than printing without displaying a warning even if a head is removed and attached in the printer unit 1300.

If it is determined in Step S52 that the function to be executed is related to printing, the flow goes to Step S53 to check the print-related function selected in Step S52. Specifically, it is determined whether the selected function is the "print position adjustment function." If it is, the flow goes to Step S59 to execute the function selected in the Step S51.

If it is determined in Step S53 that a function other than the "print position adjustment function" is selected, the flow goes to Step S54 to determine whether the request flag 1314 for print position adjustment stored in the control unit 1310 of the printer unit 1300 is on. Incidentally, although determination as to whether a head has been replaced or removed and then attached is made here based on whether the flag 1314 is on, the present invention is not limited to this. The determination may be made based on the status of the printer unit 1300. If it is determined in Step S54 that the request flag 1314 for print position adjustment is off, the flow goes to Step S59 to execute the function selected in Step S51. On the other hand, if the request flag 1314 is on, meaning that a head has been replaced or removed and then attached, the flow goes to Step S55 to present a screen on the display 1510 of the console panel 1302, prompting for the print position adjustment.

FIG. 15 depicts an outside view showing an example of the console panel 1302.

The display 1510 shows a screen prompting for the print position adjustment because a head cartridge has been removed or replaced. Furthermore, since the Color check box 1501 is marked as in the case of the third embodiment, it can be seen that the color head cartridge (inkjet head) has been removed or replaced. Now, the user can select Adjust Print Position 1502 or Adjust Print Position Later 1503 by moving a cursor (not shown) with the Up, Down, Left, and Right cursor keys on the button 1511, press OK on the button 1511, and thereby select and execute one of the processes.

Incidentally, the items on the display 1510 may be selected, for example, using a touch panel instead of the cursor keys.

In Step S56, it is determined whether Adjust Print Position 1502 is selected. If the function is selected, the flow goes to Step S57 to actually print the pattern for the print position adjustment using the cartridge selected in the display screen. When the printing of the pattern for the print position adjustment is finished, the flow goes to Step S59 to execute the function selected in Step S51. For example, if a copy function is selected in Step S51, after the pattern for the print position adjustment is printed in Step S57 and the user enters print adjustment data based on the printing results, a copying process is performed.

If it is determined in Step S56 that Adjust Print Position 1502 is not selected, the flow goes to Step S58 to determine whether Adjust Print Position Later 1503 is selected. If it is, the flow goes to Step S59 to execute the function selected in Step S51 instead of performing any process for the print position adjustment.

As described above, according to the fourth embodiment, as with the printer described above, a stand-alone printer can automatically identify a replaced or removed and then attached printhead, store information as to the need for the print position adjustment of the head, and warn the user of the need for the print position adjustment.

Furthermore, the printer allows the user to choose between adjusting the print position right away and adjusting the print position later at the user's convenience such as after the printing process.

Next, the print position adjustment according to the fourth embodiment will be described briefly.

Figure 16:
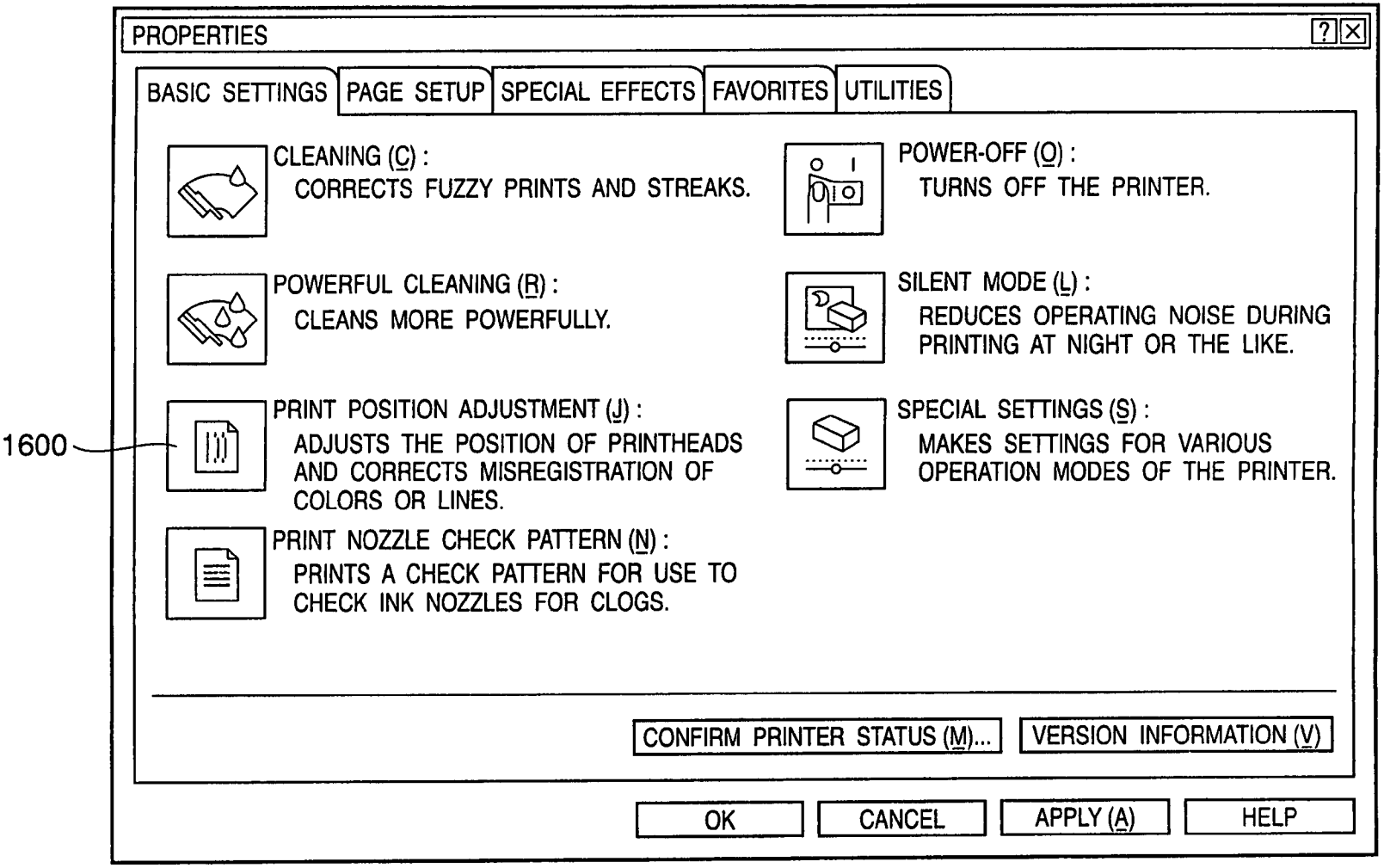
FIG. 16 is a diagram showing an example of a utility screen of the printer driver according to this embodiment.

FIG. 16 is a diagram showing an example of a utility screen of the printer driver 302 according to these embodiments.

If Adjust Print Position 1600 is pointed to by the mouse cursor and clicked on with the mouse 206, print position adjustment data (check data) is transmitted from the printer driver 302 to the printer 102.

Figure 17:
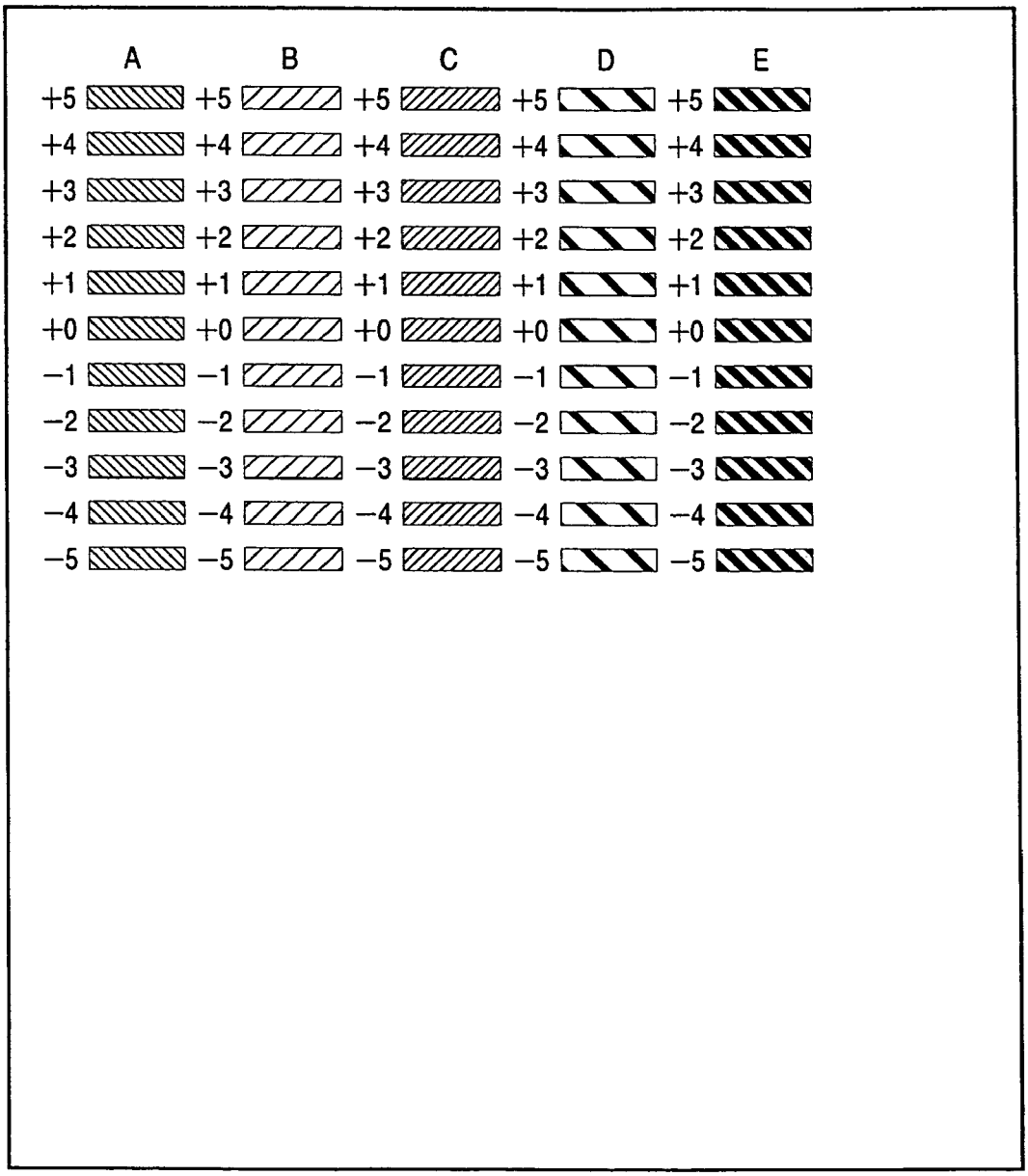
FIG. 17 is a diagram showing an example of printed results of print position adjustment data for a color head cartridge.

FIG. 17 is a diagram showing an example of printing results of the print position adjustment data transmitted from the printer driver 302 to the printer 102 according to these embodiments.

In this case, the print position adjustment data for a five-color head is printed. After the check pattern data are printed on the printer 102, a screen such as shown in FIG. 18 is brought up on the display 207.

Figure 18:
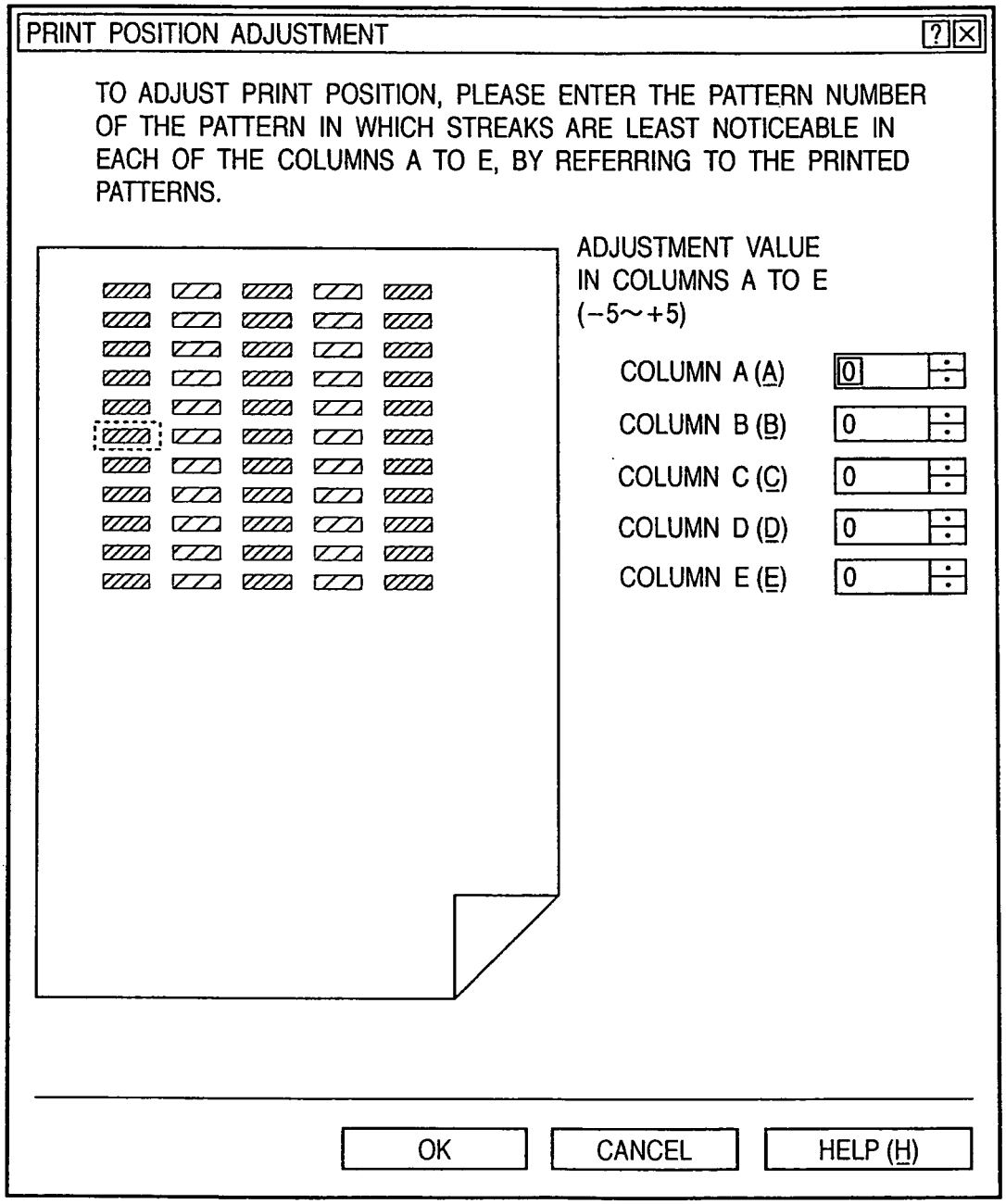
FIG. 18 is a diagram showing an example of a screen used to verify the printed results of the print position adjustment data.

FIG. 18 is a diagram showing an example of a screen used to verify the printing results of the print position adjustment data, where the screen is brought up on the display 207 by the printer driver 302.

The user is asked to determine and enter a pattern number (between +5 and −5) of the pattern in which streaks are least noticeable in each of columns A to E in the printing example in FIG. 17. The values thus entered are stored in a table (provided in the ROM 203) of the printer driver 302 and transmitted to the printer 102. These print position adjustment data are used later to adjust print position (to shift dots) of print data to be outputted to head cartridges (heads) of different colors.

Incidentally, the present invention is also achieved when program code of software programs which implement the functions of the above embodiment is supplied directly or remotely to a system or apparatus and read out and executed by a computer of the system or apparatus. In that case, as long as the software functions as programs, it does not need to take the form of programs. Thus, the program code itself installed on the computer to implement functions and processes of the present invention on the computer also implements the present invention. That is, the present invention also includes computer programs which implement the functions and processes of the present invention. In that case, the program code may take any form including object code, programs executed by an interpreter, and script data supplied to an OS as long as it functions as programs.

Storage media available for use to supply programs include, for example, floppy (registered trademark) disks, hard disks, optical disks, magneto-optical disks (MO), CD-ROM, CD-R, CD-RW, magnetic tape, non-volatile memory cards, ROM, DVD (DVD-ROM and DVD-R), etc. The programs can also be supplied by allowing the user to connect to an Internet homepage using a browser on a client computer and download the computer programs themselves of the present invention or a compressed self-installing file from the homepage onto a recording medium such as a hard disk. Also, the program code of the programs according to the present invention may be divided into multiple files, which can be downloaded from respective homepages. That is, the present invention also includes WWW servers which allow multiple users to download program files capable of implementing the functions and processes of the present invention on a computer.

The present invention can also be implemented by supplying users with a storage medium such as a CD-ROM containing the programs of the present invention in encrypted form, providing key information for decryption to the user who satisfies predetermined conditions through a download from an Internet homepage, and allowing the user to decrypt and install the programs on a computer using the key information.

The functions of the above embodiments may be implemented not only by the programs read out and executed by the computer, but also by part or all of the actual processing executed, in accordance with instructions from the programs, by an OS running on the computer.

Furthermore, the functions of the above embodiments may also be implemented by part or all of the actual processing executed by a CPU or the like contained in a function expansion board inserted in the computer or a function expansion unit connected to the computer if the processing is performed in accordance with instructions from the programs that have been read out of the recording medium and written into memory on the function expansion board or unit.

As described above, according to the embodiments, at the time of the first printing after a printer head is replaced or removed, a dialog box is displayed to assist print position adjustment. Thus, the user who feels the need for the print position adjustment adjusts print position as a matter of course. However, the user may not want to make the adjustment right away. In that case, the user can go ahead with normal printing instead of making print position adjustment. At the time of the second and subsequent printing, the dialog box for guide of print position adjustment does not appear regardless of whether the print position has actually been adjusted. Consequently, the user does not receive an impression of being warned because the dialog box prompting for print position adjustment is not displayed repeatedly if the user chooses not to make adjustment. This makes it possible to provide a user-friendly UI while providing the minimum necessary guidance. Furthermore, this embodiment has the advantage of being able to adjust print position efficiently.

The present invention is not limited to the above embodiment, and various changes and modifications can be made thereto within the spirit and scope of the present invention.

Therefore, to apprise the public of the scope of the present invention, the following claims are made.

This application claims the benefit of Japanese Patent Application No. 2005-200650 filed on Jul. 8, 2005, which is hereby incorporated by reference herein in its entirety.

What is claimed is:

1. A printer control method for controlling a print system including a printer and a host computer, the method comprising:

obtaining, from the printer by the host computer, first information indicating whether or not a print position adjustment of a printhead mounted on the printer is necessary;

notifying a user with a prompt to effect the print position adjustment of the printhead if the first information obtained in the obtaining step indicates that the print position adjustment is necessary;

generating, using the host computer, a print job including second information designating that the print position adjustment is necessary and requesting to change the first information, when the user selects to effect the print position adjustment in response to a notification in the notifying step;

transmitting, from the host computer, the print job including the second information to the printer;

executing, by the printer, the print position adjustment in response to the print job including the second information;

changing, within the printer, the first information to indicate that the print position adjustment of the printhead is not necessary in response to the second information; and determining whether or not the print job has been successfully completed and if determined that the print job has not been successfully completed, then transmitting third information from the host computer to the printer in order to restore the first information that was changed by the print job including the second information.

2. The method according to claim 1, wherein the first information is generated upon the printhead being mounted or replaced on the printer and is stored in a memory of the printer.

3. The method according to claim 1, wherein the printhead comprises plural cartridges and the print position adjustment is performed for only a cartridge that has been newly mounted or replaced.

4. The method according to claim 1, wherein the print job including the second information includes a print position adjustment pattern to be printed by the printer.

5. A print system including a printer and a host computer, the host computer comprising:

an obtaining unit that obtains from the printer first information indicating whether or not a print position adjustment of a printhead mounted on the printer is necessary;

a notification unit that notifies a user with a prompt to affect the print position adjustment of the printhead if the first information obtained by the obtaining unit indicates that the print position adjustment is necessary;

a generation unit that generates a print job including second information designating that the print position adjustment is necessary and requesting to change the first information, when the user instructs to effect the print position adjustment in response to a notification by the notifying unit;

a transmission unit that transmits the print job including the second information to the printer;

a determination unit that determines whether or not the print job has been successfully completed; and a sending unit that sends third information from the host computer to the printer in order to restore the first information that was changed by the print job including the second information, if determined by the determination unit that the print job has not been successfully completed, and the printer comprising:

an execution unit that executes the print position adjustment in response to the print job including the second information;

a changing unit that changes the first information to indicate that the print position adjustment of the printhead is not necessary in response to the second information; and a restoring unit that restores the first information that was changed by the changing unit, in response to the third information received from the host computer.

6. The system according to claim 5, wherein the first information is generated upon the printhead being mounted or replaced on the printer and is stored in a memory of the printer.

7. The system according to claim 5, wherein the printhead comprises plural cartridges and the print position adjustment is performed for only a cartridge that has been newly mounted or replaced.

8. The system according to claim 5, wherein the print job including the second information includes a print position adjustment pattern to be printed by the printer.

* * * * *